US006031497A

United States Patent [19]

Nam

[11] Patent Number: 6,031,497

[45] Date of Patent: Feb. 29, 2000

[54] ANTENNA APPARATUS FOR SMART PHONE

[75] Inventor: Sang-Min Nam, Suwon-shi, Rep. of Korea

[73] Assignee: SamSung Electronics Co., Ltd., Suwon, Rep. of Korea

[21] Appl. No.: 09/217,933

[22] Filed: Dec. 22, 1998

[30] Foreign Application Priority Data

Dec. 22, 1997 [KR] Rep. of Korea ..... 97-39591

[51] Int. Cl.[7] ..... H01Q 1/24

[52] U.S. Cl. ..... 343/702; 343/906; 455/90

[58] Field of Search ..... 343/702, 901, 343/903, 906; 455/89, 90

[56] References Cited

U.S. PATENT DOCUMENTS 5,255,001 10/1993 Tamura et al. ..... 343/702

5,644,320 7/1997 Rossi ..... 343/702

*Primary Examiner*—Don Wong
*Assistant Examiner*—Tan Ho
*Attorney, Agent, or Firm*—Robert E. Bushnell, Esq.

[57] ABSTRACT

A foldable and stretchable antenna for a smart phone being installed in the interior of an upper body of the smart phone. The upper body has a prolonged groove formed at an upper end thereof and an opening formed at an inner end portion of the prolonged groove. A spring is placed in the opening and a protrusion is mounted on the spring, thus being movable up and down. A stretchable antenna is rotatably mounted on the protrusion by means of a hinge pin. The antennal has a plurality of concaves formed at a bottom and a side thereof so that the protrusion is stuck in the concaves when the antenna is folded and unfolded. Further the lower body includes a holding element for holding the antenna in the prolonged groove when the upper body is folded down to the lower body. The smart phone can include a cellular communications center and a personal digital assistant.

20 Claims, 4 Drawing Sheets

ANTENNA APPARATUS FOR SMART PHONE

CLAIM OF PRIORITY

This application makes reference to, incorporates the same herein, and claims all benefits accruing under 35 U.S.C. § 119 from an application entitled ANTENNA APPARATUS FOR SMART PHONE earlier filed in the Korean Industrial Property Office on the 22nd day of December 1998, and there duly assigned Ser. No. 97-39591, a copy of which is annexed hereto.

BACKGROUND OF THE INVENTION

1. Technical Field

The present invention relates to an antenna apparatus for a smart phone, and in particular, to a foldable and stretchable antenna apparatus for a smart phone.

2. Related Art

A telephone set in wide use today is known as a standard tone telephone set. The standard tone telephone set is a telephone set which uses a method called a dual tone multifrequency (DTMF) for sending a telephone number to a central office when placing a telephone call. The term "central office" refers to switching equipment that provides local exchange telephone service for a given geographical area, designated by the first three digits of a seven-digit telephone number in the United States of America. A local network is used to connect telephones in residences and businesses to central offices. Exchange area networks are disposed between local networks and long-distance networks.

The dual tone multifrequency (DTMF) method can only be utilized when the central office is equipped to process the dual tone multifrequency (DTMF) signals. Standard tone telephone sets have been replacing rotary dial telephone sets. Standard tone telephone sets include a push-button keypad for dialing. The push-button keypad has 12 keys, which represent the numbers 0 through 9 and the symbols * and #. Pressing one of these 12 keys causes an electronic circuit to generate two tones, each tone having a different frequencies. Hence the name dual tone multifrequency (DTMF).

There is a low frequency tone for each row of keys across the keypad and a high frequency for each column of keys down the keypad. Pressing key 7, for example, generates an 852 hertz tone and a 1,209 hertz tone. Pressing key 1, which is in the same column as key 7, generates a 697 hertz tone and the 1,209 hertz tone. Pressing key 9, which is in the same row as key 7, generates the 852 hertz tone and a 1,477 hertz tone. By using the dual tone method, 12 unique combinations are produced from only seven tones when the 12-position keypad is used.

A cellular telephone system provides a wireless connection to a public switched telephone network (PSTN) for any user location within the radio range of the system. Cellular systems accommodate a large number of users over a large geographic area, within a limited frequency spectrum. Cellular radio systems provide high quality service that is often comparable to that of the landline telephone systems. High capacity is achieved by limiting the coverage of each base station transmitter to a small geographic area called a cell so that the same radio channels may be reused by another base station located some distance away. A sophisticated switching technique called a handoff enables a call to proceed uninterrupted when the user moves from one cell to another.

A smart phone is a combined communication terminal of a cellular phone and a personal digital assistant (PDA). A personal digital assistant can be a small computer system which may include an electronic calendar, e-mail transmitting and receiving capabilities, faxing capabilities, a memory for recording appointments and things to do, word processor software for writing letters and notes, buttons and keys for entering information, a touch-sensitive display for displaying and entering information, connectors for connecting the personal digital assistant with a computer system and a printer and a land-based telephone system and other components.

A personal digital assistant can be a computer system. Computer systems are information handling systems that are utilized by many individuals and businesses today. A computer system can be defined as a microcomputer that includes a central processing unit (CPU), a volatile memory, a non-volatile memory such as read only memory (ROM), a display monitor, a keyboard, a mouse or other input device such as a trackball, a floppy diskette drive, a compact disc-read only memory (CD-ROM) drive, a modem, a hard disk storage device, and a printer. A computer system's main board, which is a printed circuit board known as a motherboard, is used to electrically connect these components together.

The central processing unit is often described as a microprocessor. The microprocessor is an electronic component having internal logic circuitry handling most, if not all, the data processing in the computer system. The internal logic circuitry of microprocessors is typically divided into three functional parts known as the input/output (I/O) unit, the control unit, and the arithmetic-logic unit (ALU). These three functional parts interact together and determine the power and performance of the microprocessor. The combination of the control unit and the arithmetic-logic unit can be referred to as the central processing unit. Also, the combination of the input/output unit, the control unit, and the arithmetic-logic unit can be referred to as the central processing unit.

Computer systems include a basic input output system (BIOS) which is an especially important program stored in read only memory (ROM). The basic input output system (BIOS) tests a computer every time the computer is powered on. The basic input output system (BIOS) can allocate a computer system's resources automatically, making adjustments needed to accommodate new hardware. Also, the basic input output system (BIOS) governs how system board components interact.

When the computer system is powered on, the basic input output system (BIOS) immediately takes control of the computer system and its components. The first duty of the basic input output system (BIOS) is to perform a series of diagnostic routines called the power on self test (POST) routine, which ensures that every part of the computer system's hardware is functioning properly.

A basic input output system (BIOS) that is stored in flash-read-only-memory (flash-ROM) is vulnerable to computer viruses. Computer viruses include malicious computer programs which can be used to erase information stored in memory. I believe there is a need to provide a method of coping with such malicious programs in order to protect a basic input output system (BIOS) stored in flash-read-only-memory (flash-ROM).

Such a smart phone has an antenna for radio communication. Since the antenna is mounted on the outer side of an upper body of the smart phone, there is a limitation in designing a long antenna, which may lead to deterioration of the antenna efficiency.

I have discovered that there is a need to provide a smart phone with a long antenna that is convenient to use and that is also portable.

SUMMARY OF THE INVENTION

It is therefore an object of the present invention to provide a foldable and stretchable antenna for a smart phone, which is installed in the interior of an upper body of the smart phone.

To achieve the above object, there is provided an antenna apparatus for a foldable smart phone having an upper body and a lower body. The upper body has a prolonged groove formed at an upper end thereof and an opening formed at an inner end portion of the prolonged groove. A spring is placed in the opening and a protrusion is mounted on the spring, thus being movable up and down. A stretchable antenna is rotatably mounted on the protrusion by means of a hinge pin. The antennal has a plurality of concaves formed at a bottom and a side thereof so that the protrusion is stuck in the concaves when the antenna is folded and unfolded. Further the lower body includes a holding element for holding the antenna in the prolonged groove when the upper body is folded down to the lower body.

To achieve these and other objects in accordance with the principles of the present invention, as embodied and broadly described, the present invention provides an apparatus, comprising: a body forming a groove along an exterior edge of said body, wherein the groove has a first end and a second end; said body forming an aperture at the first end of the groove; a spring being received into the aperture; a protrusion mounted on said spring, said protrusion being movable up and down, said protrusion extending out from the aperture into the groove; a hinge pin mounted to said body adjacent to the first end of the groove; an antenna having a first end rotatably mounted to said hinge pin of said body and having a second end, the first end of said antenna being movably coupled to said protrusion; and said antenna forming at least two orifices at the first end of said antenna including a first and a second orifice, the first orifice receiving said protrusion to secure said antenna when said antenna is in a first position wherein said antenna extends away from said body and said antenna is not received by the second end of the groove, the second orifice receiving said protrusion to secure said antenna when said antenna is in a second position wherein said antenna is received by the second end of the groove, said antenna receiving data to said body and transmitting data from said body.

To achieve these and other objects in accordance with the principles of the present invention, as embodied and broadly described, the present invention provides an apparatus, comprising: a body for transmitting and receiving data, said body forming a groove along an exterior edge of said body, wherein the groove has a first end and a second end, said body forming an aperture at the first end of the groove; a spring being received into the aperture; a protrusion mounted on said spring, said protrusion being movable up and down, said protrusion extending out from the aperture into the groove; a hinge pin mounted to said body adjacent to the first end of the groove; an antenna having a first end rotatably mounted to said hinge pin of said body and having a second end, the first end of said antenna being movably coupled to said protrusion, said antenna being utilized to transmit the data from said body and to receive the data to said body; said antenna forming at least two orifices at the first end of said antenna including a first and a second orifice, the first orifice receiving said protrusion to secure said antenna when said antenna is in a first position wherein said antenna extends away from said body and said antenna is not received by the second end of the groove, the second orifice receiving said protrusion to secure said antenna when said antenna is in a second position wherein said antenna is received by the second end of the groove; said body further comprising: an upper part having the exterior edge whereat the groove is formed, said upper part also having a second edge and a front face; a lower part having an exterior edge, a second edge, and a front face; a hinge part rotatably coupling said upper part and said lower part, wherein said hinge part is mounted to the second edge of said upper part and to the second edge of said lower part, said body being rotated between an open and a closed position by means of said hinge part; and said body being folded to the closed position when the exterior edge of said upper part is adjacent to the exterior edge of said lower part and the front face of said upper part is adjacent to the front face of said lower part, said body being unfolded to the open position when the exterior edge of said upper part is not adjacent to the exterior edge of said lower part and the front face of said upper part is not adjacent to the front face of said lower part.

To achieve these and other objects in accordance with the principles of the present invention, as embodied and broadly described, the present invention provides a method, comprising: forming a groove at an exterior edge of a body, the groove having a first end and a second end, and forming an aperture at the first end of the groove; placing a spring into the aperture; mounting a protrusion onto the spring; and rotatably mounting a first end of an antenna to the body adjacent to the first end of the groove, wherein the first end of the antenna forms at least two orifices including a first and a second orifice, the first orifice receiving the protrusion to stabilize the antenna when the antenna is in a first position extending away from the body and the antenna is not received by the second end of the groove, the second orifice receiving the protrusion to stabilize the antenna when the antenna is in a second position and is received by the second end of the groove, the antenna receiving data to the body and transmitting data from the body.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to exemplify the principles of this invention.

DETAILED DESCRIPTION OF THE PREFERRED EMBODIMENT

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
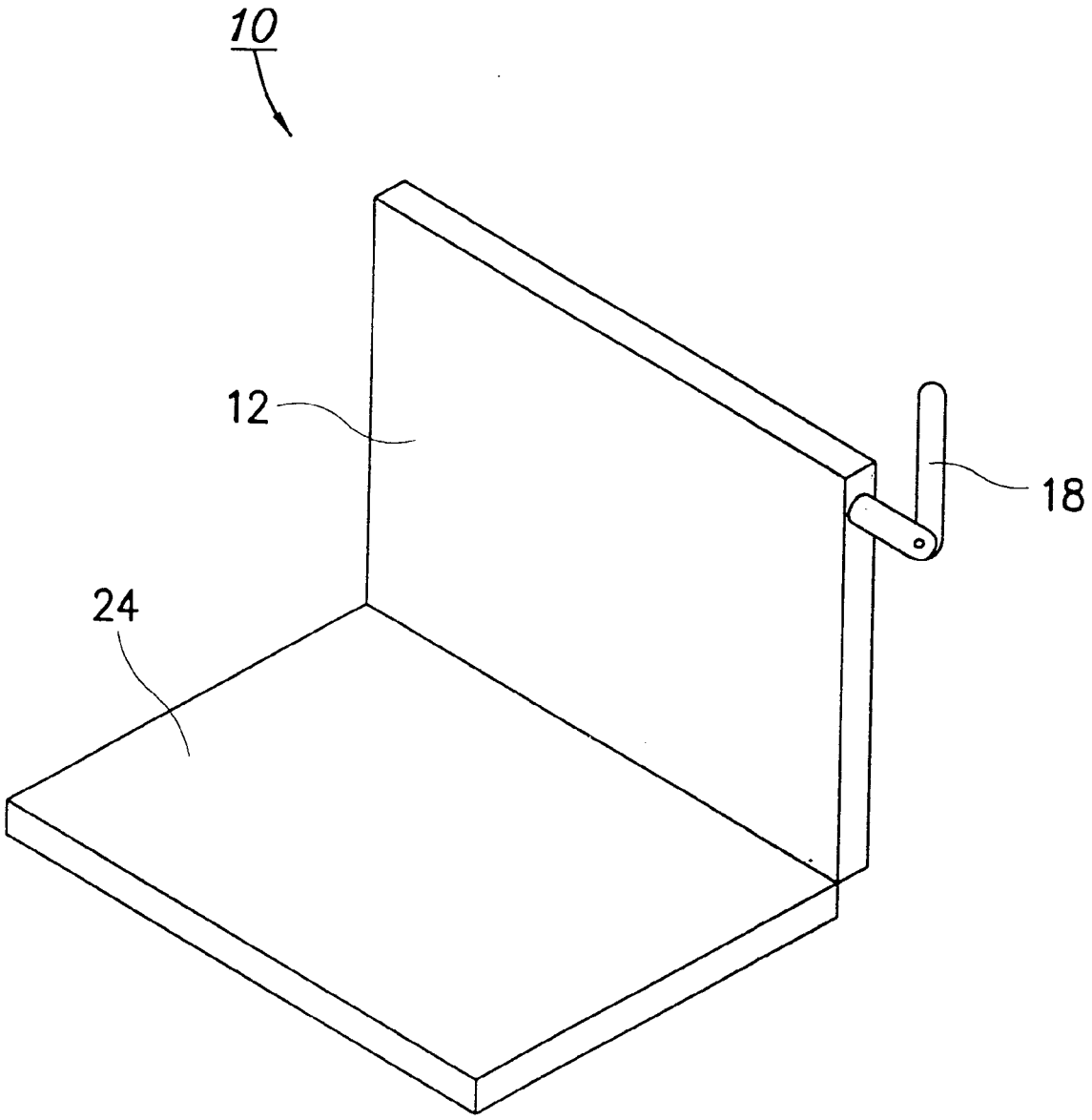
FIG. 1 is a diagram illustrating a smart phone with an antenna.

Turn now to FIG. 1, which is a diagram illustrating a smart phone with an antenna. FIG. 1 illustrates a foldable smart phone 10. As illustrated, the foldable smart phone 10 includes an upper body 12, a lower body 24, and an antenna 18 mounted on an outer side of the upper body 12. A user will fold the smart phone 10 to close it and to use it as a cellular phone, and unfold the smart phone 10 to open it and to use it as a personal digital assistant. Therefore, for use of the personal digital assistant, the upper body 12 includes, for example, a speaker and a display, and the lower body 24 includes a keypad. The display included in the upper body 12 faces the keypad of the lower body 24 when the phone 10 is folded closed. Further, for use of the cellular phone, the upper body 12 includes another keypad for dialing mounted on the back side of the upper body 12. As illustrated, the antenna 18 is foldable, so that the user may turn the antenna 18 up to use the smart phone 10 as the personal digital assistant and straighten or unfold the antenna 18 to use the smart phone 10 as the cellular phone.

A preferred embodiment of the present invention will be described in detail with reference to the accompanying drawings, in which the like reference numerals denote the like or equivalent elements. In the specification, well-known functions or constructions which may obscure the invention in unnecessary detail are not described in detail.

Figure 2:
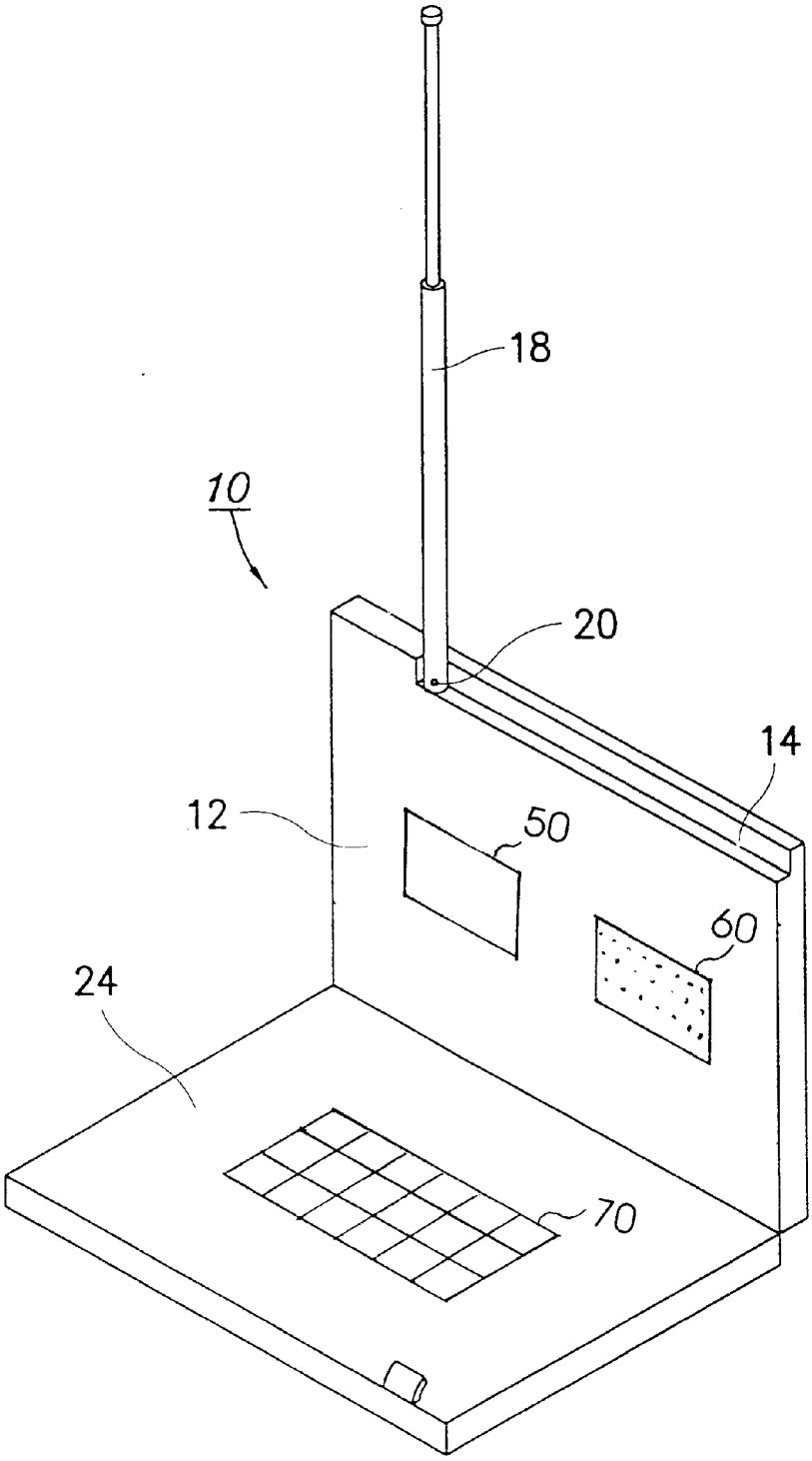
FIG. 2 is a diagram illustrating a smart phone with an antenna in which the antenna is stood up and stretched out, in accordance with the principles of the present invention.
Figure 3:
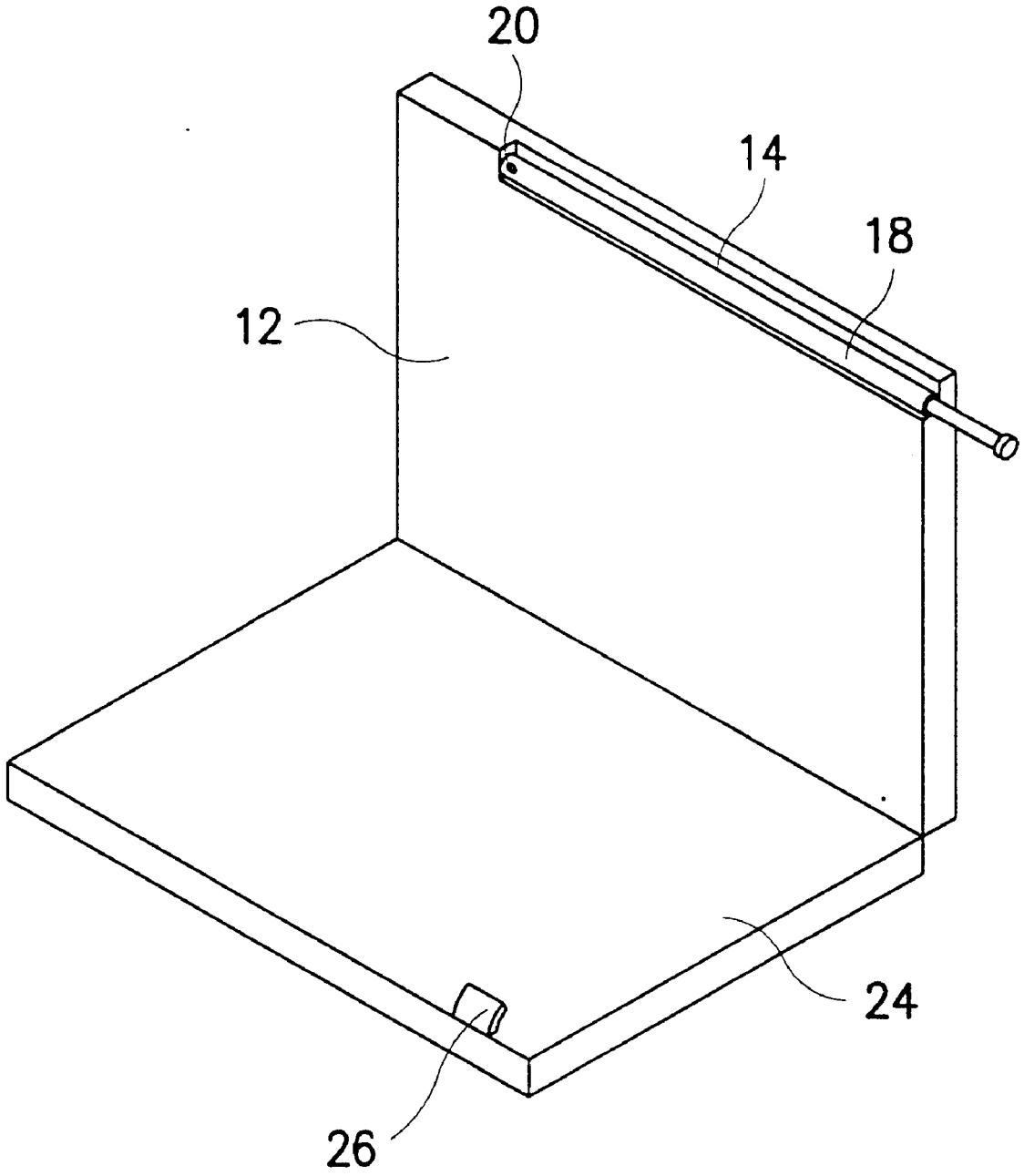
FIG. 3 is a diagram illustrating the smart phone with the antenna in which the antenna is folded or laid down and inserted or telescoped, in accordance with the principles of the present invention.
Figure 4:
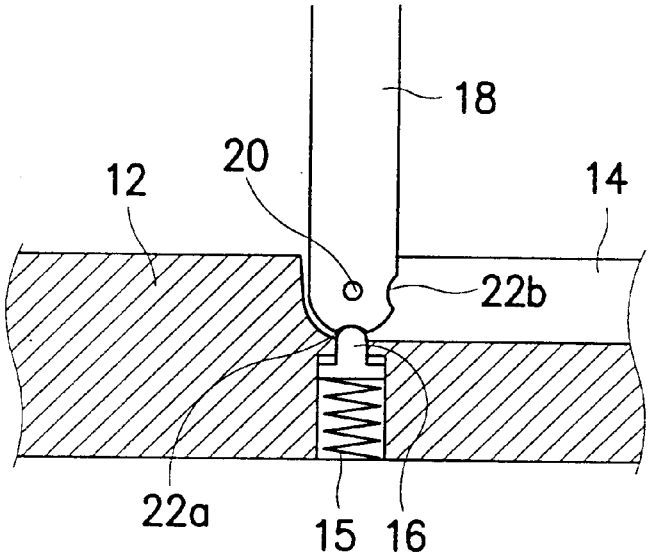
FIG. 4 is a detailed diagram illustrating the case where the antenna is stood up, in accordance with the principles of the present invention.
Figure 5:
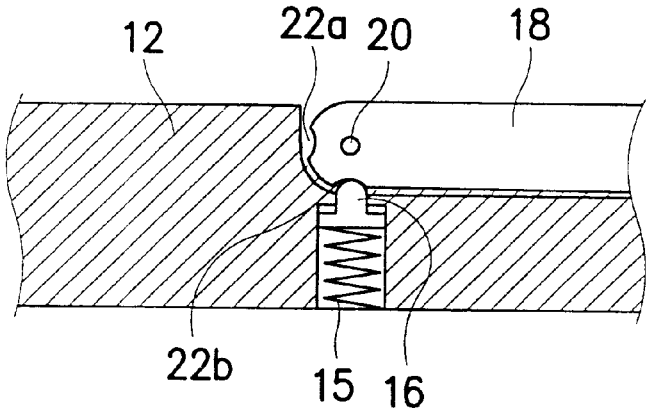
FIG. 5 is a detailed diagram illustrating the case where the antenna is folded, in accordance with the principles of the present invention.

Turn now to FIGS. 2 through 5. FIG. 2 is a diagram illustrating a smart phone with an antenna in which the antenna is stood up and stretched out, in accordance with the principles of the present invention. FIG. 3 is a diagram illustrating the smart phone with the antenna in which the antenna is folded or laid down and inserted or telescoped, in accordance with the principles of the present invention. FIG. 4 is a detailed diagram illustrating the case where the antenna is stood up, in accordance with the principles of the present invention. FIG. 5 is a detailed diagram illustrating the case where the antenna is folded, in accordance with the principles of the present invention.

Referring to FIGS. 2 to 5, a portable smart phone 10 is composed of an upper body 12, a lower body 24 and a stretchable antenna 18. The upper body 12 includes, for example, a speaker 60 and a display 50, and the lower body 24 includes a keypad 70. The display 50 included in the upper body 12 faces the keypad 70 of the lower body 24.

The upper body 12 has a prolonged groove 14 formed at an upper end thereof, at which the stretchable antenna 18 is placed when the smart phone 10 is folded closed. Further, the upper body 14 has an opening formed at an end portion of the prolonged groove 14. See FIGS. 4 and 5. In the opening, a hemispheric protrusion 16 is installed to be movable up and down. Under the protrusion 16 is placed a coiled compression spring 15, a lower end of which is connected to a signal line (not shown). The antenna 18 is rotatably installed over the protrusion 16 by using a hinge pin 20. The antenna 18 has hemispheric concaves 22*a* and 22*b* at the bottom and the right side thereof, respectively, so that the protrusion 16 can be stuck in the concaves 22*a* and 22*b* while the user folds and unfolds the antenna 18. Further, the lower body 24 of the smart phone 10 has a holding element 26 positioned to hold the antenna 18 in the prolonged groove 14 of the upper body 12 when the smart phone 10 is folded.

In operation, when using the smart phone 10 as the personal digital assistant, the user will open the upper body 12 and then stand or unfold the antenna 18 up around the hinge 20 until the protrusion 16 is stuck in the concave 22*a* of the antenna 18. See FIG. 4. In addition, the user may stretch or extend the antenna 18, if necessary, to lengthen it.

On the contrary, when using the smart phone 10 as the cellular phone, the user will lay or fold the antenna 18 down to the prolonged groove 14 until the protrusion 16 is stuck in the concave 22*b*, see FIG. 5, and then fold the upper body 12 down to the lower body 24. In this situation, the holding element 26 prevents the antenna 18 from escaping from the prolonged groove 14. Of course, the user may stretch the antenna 18, when necessary.

With reference to FIG. 2, the display 50 can be a cathode ray tube, a liquid crystal display, a gas-plasma display, a light emitting diode display, an electro-luminescent display, or a field emission display. The lower body 24 can include the central processing unit (CPU) of the personal digital assistant. Or the upper body 12 can include the central processing unit of the personal digital assistant. The central processing unit of the personal digital assistant is not shown. The smart phone 10 also includes a memory, not shown.

As described above, the smart phone has the foldable and stretchable antenna installed in the interior of an upper body, which facilitates designing of a longer antenna, for improving the antenna efficiency.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An electronic apparatus, comprising:

a body forming a groove along a peripheral member of said body, said groove having a first end and a second end and a length separating said first end from said second end;

a detent biased at the first end of the groove to reciprocate into said groove;

an antenna operationally connected to said body to conduct electromagnetic signals bearing data between said body and an environment ambient to said body, said antenna having a first end and a second end, the first end of said antenna being rotatably coupled to said body to engage said detent; and said first end of said antenna bearing a plurality of discrete and spaced-apart recesses, with a first one of said recesses receiving said detent and restraining said antenna when said antenna extends obliquely away from said body and a second one of said recesses receiving said detent and securing said antenna when said antenna extends along said length.

2. The apparatus of claim 1, further comprising a spring installed in said body at the first end of the groove, biasing said detent into engagement with the first end of said antenna.

3. The apparatus of claim 1, further comprising a holding element formed on said body to hold said antenna in the groove.

4. The apparatus of claim 1, wherein said detent is hemispherical.

5. The apparatus of claim 1, wherein said plurality of recesses formed by said antenna are hemispherical.

6. The apparatus of claim 1, wherein said antenna can be lengthened and shortened.

7. The apparatus of claim 1, wherein said body further comprises:

an upper part having an exterior edge whereat the groove is formed, said upper part also having a second edge and a front face;

a lower part having an exterior edge, a second edge, and a front face;

a hinge part rotatably coupling said upper part and said lower part, wherein said hinge part is mounted to the second edge of said upper part and to the second edge of said lower part, said body being rotated between an open and a closed position by means of said hinge part; and said body being folded to the closed position when the exterior edge of said upper part is adjacent to the exterior edge of said lower part and the front face of said upper part is adjacent to the front face of said lower part, said body being unfolded to the open position when the exterior edge of said upper part is not adjacent to the exterior edge of said lower part and the front face of said upper part is not adjacent to the front face of said lower part.

8. The apparatus of claim 7, further comprising a video display installed at the front face of said upper part, said video display conveying varying visual information to a user.

9. The apparatus of claim 8, wherein said video display is selected from among a cathode ray tube, a liquid crystal display, a gas-plasma display, a light emitting diode display, an electro-luminescent display, and a field emission display.

10. An electronic apparatus, comprising:

a body forming a groove along an exterior edge of said body, wherein the groove has a first end and a second end and a length separating said first end from said second end;

a spring being received at the first end of the groove;

a detent mounted on said spring, said detent being movable up and down, said detent extending out from the aperture into the groove;

an antenna operationally connected to said body to conduct electromagnetic signals bearing data between said body and an environment ambient to said body, said antenna having a first end and a second end, the first end of said antenna being rotatably coupled to said detent; and said antenna forming at least two orifices at the first end of said antenna including a first and a second orifice, the first orifice receiving said detent and restraining said antenna when said antenna extends obliquely away from said body, the second orifice receiving said detent and restraining said antenna when said antenna extends along said length.

11. The apparatus of claim 10, said body further comprising:

an upper part having the exterior edge whereat the groove is formed, said upper part also having a second edge and a front face;

a lower part having an exterior edge, a second edge, and a front face;

a hinge part rotatably coupling said upper part and said lower part, wherein said hinge part is mounted to the second edge of said upper part and to the second edge of said lower part, said body being rotated between an open and a closed position by means of said hinge part; and said body being folded to the closed position when the exterior edge of said upper part is adjacent to the exterior edge of said lower part and the front face of said upper part is adjacent to the front face of said lower part, said body being unfolded to the open position when the exterior edge of said upper part is not adjacent to the exterior edge of said lower part and the front face of said upper part is not adjacent to the front face of said lower part.

12. The apparatus of claim 11, further comprising a holding element formed adjacent to the exterior edge of said lower part of said body, said holding element holding said antenna in the groove when said body is folded to the closed position.

13. The apparatus of claim 10, wherein the at least two orifices have a concave surface.

14. The apparatus of claim 10, wherein said antenna can be lengthened and can be shortened.

15. A method, comprising:

forming a groove at an exterior edge of a body, the groove having a first end and a second end and a length separating said first end from said from said second end;

installing a spring at the first end of the groove;

mounting a protrusion onto said spring; and mounting an antenna to said body, said antenna forming a plurality of discrete and spaced-apart orifices, a first one of said plurality of orifices receiving said protrusion to stabilize said antenna when said antenna extends obliquely away from said body, and a second one of said plurality of orifices receiving said protrusion to stabilize said antenna when said antenna extends along said length, said antenna being operationally connected to said body to conduct electromagnetic signals bearing data between said body and an environment ambient to said body.

16. The method of claim 15, wherein said body corresponds to a device for wireless telephonic communications.

17. The method of claim 15, further comprising installing a holding element on said body to hold said antenna in the groove.

18. The method of claim 15, wherein said protrusion is hemispherical.

19. The method of claim 15, wherein said plurality of orifices formed by said antenna are hemispherical.

20. The method of claim 15, wherein said antenna can be lengthened and shortened.

* * * * *